US005437240A

United States Patent [19]

Miroyan

[11] Patent Number: 5,437,240

[45] Date of Patent: Aug. 1, 1995

[54] BOOKMARK

[76] Inventor: Mike Miroyan, 1299 Seaside Ave., San Pedro, Calif. 90731

[21] Appl. No.: 257,661

[22] Filed: Jun. 8, 1994

Related U.S. Application Data

[63] Continuation-in-part of Ser. No. 77,554, Jun. 14, 1993, Pat. No. 5,325,811.

[51] Int. Cl.[6] ..... B42D 9/00

[52] U.S. Cl. ..... 116/235; 116/240; 116/322

[58] Field of Search ..... 116/234, 235, 240, 225, 116/321, 322, 323, 324; 281/42

[56] References Cited

U.S. PATENT DOCUMENTS

| | | | |
|---|---|---|---|
| 1,008,481 | 11/1911 | Lopes | 116/235 |
| 1,899,382 | 2/1933 | Berry | 116/324 |
| 2,630,777 | 3/1953 | Johnson | 116/235 |
| 2,888,899 | 6/1959 | Graham | 116/324 |
| 3,332,687 | 7/1967 | Bennett | 116/321 X |
| 5,081,948 | 1/1992 | Walsh | 116/235 |
| 5,325,811 | 7/1994 | Miroyan | 116/235 |

*Primary Examiner*—William A. Cuchlinski, Jr.
*Assistant Examiner*—Willie Morris Worth
*Attorney, Agent, or Firm*—J. E. Brunton

[57] ABSTRACT

A bookmark for marking a page and line in a book. The bookmark includes an elongated planar body having an upper terminal portion that provides a relatively large flat surface for the display of matter such as decorative and whimsical designs each of which includes a dominant design element. The bookmark further includes a finger engaging indicator piece that substantially corresponds in size and shape with the dominant design element of the imprinted design and is slidably movable along a slit provided in the body from a first position overlying the design element to a second line marking position.

11 Claims, 5 Drawing Sheets

BOOKMARK

BACKGROUND OF THE INVENTION

This is a Continuation-In-Part application of application Ser. No. 08/077,554 filed Jun. 14, 1993, now U.S. Pat. No. 5,325,811.

1. Field of the Invention

The present invention relates generally to bookmarks. More particularly, the invention concerns speciality bookmarks of novel appearance which return the reader to the exact page and line where the reader finished reading.

2. Discussion of the Invention

A great number of bookmark constructions have been suggested in the past. Many of these constructions embody some type of line indicator element which is movable along the length of the bookmark for use in indicating a particular line of print located on a selected page of the book. Some of the line indicator elements are of relatively complex construction and involve rotatable arrows and the like. Exemplary of this type of construction is that disclosed in U.S. Pat. No. 5,081,948 issued to Walsh.

Another prior art construction disclosed in U.S. Pat. No. 4,901,665 issued to Carlin includes a slidable indicator element that is provided with index means viewable from both sides of the body for alignment with the line of interest.

A slight variation in the theme is disclosed in U.S. Pat. No. 2,630,777 issued to Johnson. The bookmark of this patent comprises a body portion provided with parallel slits which define tracks along which a line indicator element travels. The indicator element comprises oppositely extending pointers that override the tracks. A somewhat similar type of bookmark construction is disclosed in U.S. Pat. No. 1,008,481 issued to Lopes.

The bookmark of the present invention is of a substantially simpler construction than those of the prior art and also provides whimsical and decorative design indicia of which the line indicator uniquely forms a part. More particularly, the line indicator element of the bookmark corresponds in size, shape and color to one of the features of the design indicia that is imprinted upon the upper terminal portion of the bookmark. Initially, the line indicator element overlies the printed design feature to which it corresponds, but can readily be moved downwardly along a track-defining slit to a second line indicating position when the bookmark is in use. A different, or corresponding design indicia can also be imprinted on the lower terminal portion with which the indicator element can interact. The simplicity and decorative nature of the bookmark of the invention makes it highly commercially attractive and yet simple and inexpensive to manufacture.

SUMMARY OF THE INVENTION

It is an object of the present invention to provide a simple, inexpensive and efficient article for marking any page in a book and for marking a particular line of print on that page.

Another object of the invention is to provide an article of the aforementioned character which includes an elongated planar body having an upper terminal portion that provides a relatively large flat surface for the display of matter such as decorative and whimsical designs each of which includes a dominant design element.

Another object of the invention is to provide an article as described in the preceding paragraphs which includes a finger engaging indicator piece that substantially corresponds in size and shape with the dominant design element of the imprinted design and is slidably movable along the length of the elongated body from a first position overlying the design element to a second line marking position. Ultimately the indicator piece can be moved into alignment with the dominant design element of a design imprinted on the lower portion of the bookmark.

DESCRIPTION OF THE INVENTION

Figure 1:
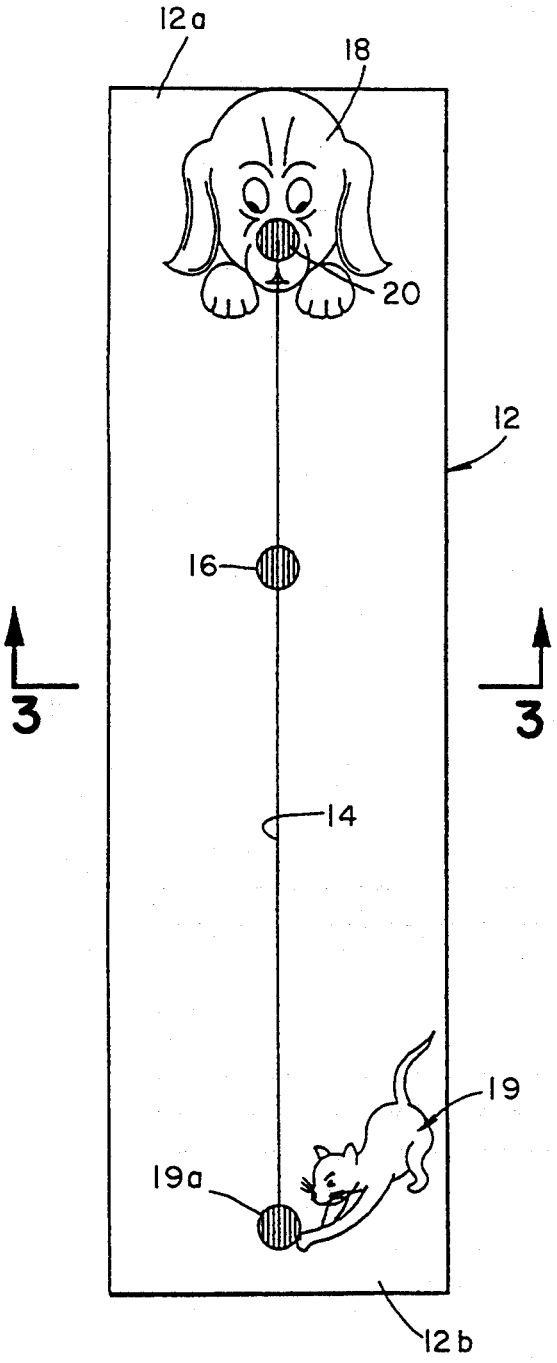
FIG. 1 is a front plan view of one form of the bookmark device of the present invention.
Figure 2:
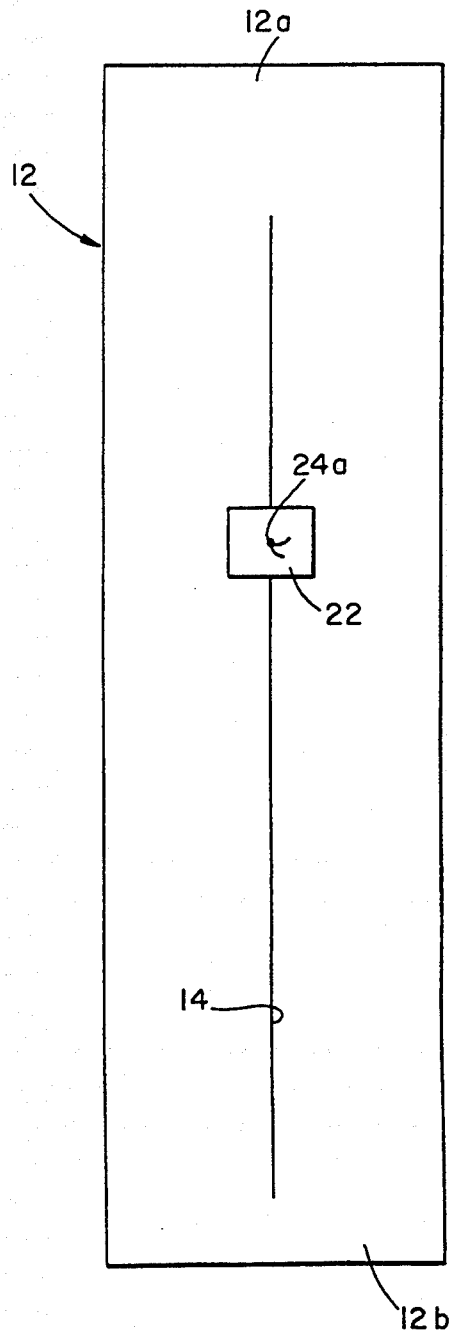
FIG. 2 is a rear plan view of the device.
Figure 3:
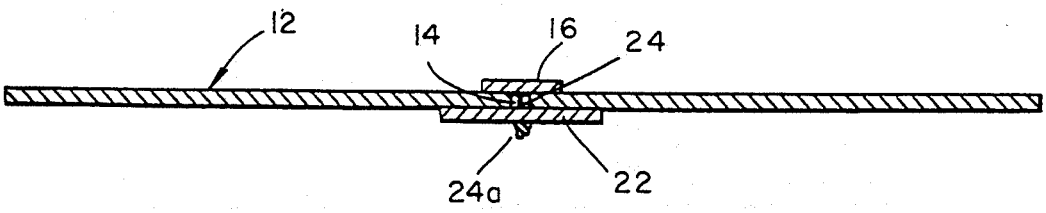
FIG. 3 is an enlarged cross-sectional view taken along lines 3—3 of FIG. 1.

Referring to the drawings and particularly to FIGS. 1, 2, and 3, the bookmark device of the present invention comprises an elongated body 12 having an upper terminal portion 12a and a lower terminal portion 12b. A longitudinally extending slit 14 extends between the upper and lower terminal portions and defines a track along which the indicator element 16 of the device can be moved in a manner presently to be described. Body 12 can be constructed from plastic, paper, cardboard, or any other suitably durable material.

As best seen in FIG. 1, a display or indicia 18, shown here in the form of a whimsical dog, is imprinted on the upper portion 12a of body 12. The display indicia 18 includes a prominent object-depicting feature shown here as the dog's nose 20 which is generally circular in shape. As shown in FIG. 1, slit 14 terminates at its upper end at the approximate center of the object-depicting feature or element 20. A second whimsical indicia here shown as a kitten 19, is imprinted on the lower terminal portion and the design feature or element such as a ball 19a interacts with the indicator element 16 when element 16 is moved to the lower extremity of the slit.

In the present form of the invention, indicator element 16 which comprises a portion of the indicator means of the invention, corresponds in size, shape and color to the dog's nose or feature 20 and also to feature 19a of the lower design. The indicator element functions to indicate a particular line on the selected page of a book such as the book shown in FIG. 4 and generally identified by the numeral 21. Further comprising the indicator means of the present embodiment of the invention is a backing member 22 which, as shown in FIG. 3, is interconnected with indicator element 16 by means of connector means shown here as a short length of connector cord 24. One end of cord 24 is affixed by any suitable means to the underside of indicator element 16 while the other end thereof extends through backing member 22 and terminates in an enlarged diameter, knot-like portion 24a which engages the rear surface of backing member 22. Cord 24 is of a length such that indicator element 16 is at all times maintained in close proximity with the front face of body 12 as the indicator element slides along its guide track which is defined by slit 14. It is to be understood that the connector means can take various forms such as snap connector, a plastic filament that is heat molded to the indicator element and the backing member, or any other suitable means for interconnecting the two members.

A highly unique feature of the device of the present invention resides in the fact that, when the bookmark is not in use, indicator element 16 overlies object-depicting feature 19a or 20 and appears to be a part of the imprinted display. In use, however, indicator element 16 can be moved away from the display, either upwardly or downwardly in the manner illustrated in FIG. 1, and into alignment with a specific line of print identified in FIG. 1 by the numeral 26.

It is to be understood that different or corresponding designs can be imprinted on both the upper and lower portions of the face of the bookmark and the indicator element can be moved from an overlying position on the upper design to an overlying position on the lower portion.

Figure 4:
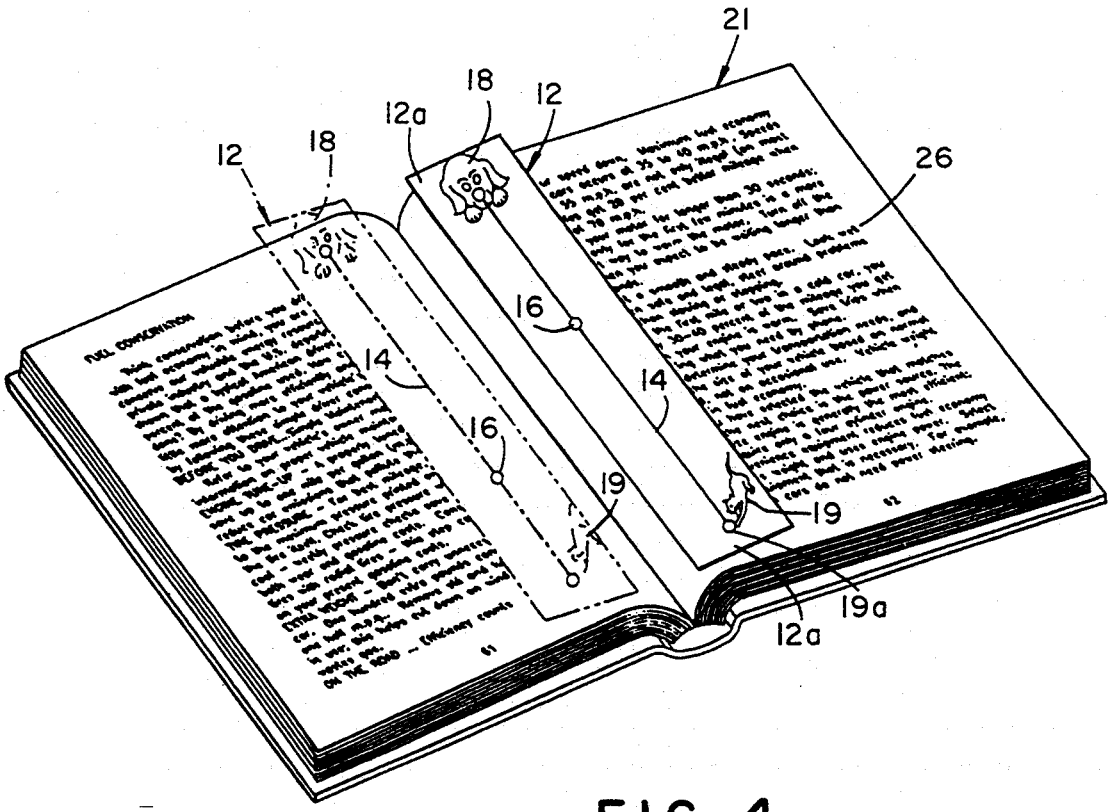
FIG. 4 is a generally illustrative view of the use of the bookmark for marking a particular page in a book and for indicating a particular line of print on that page.

Referring particularly to FIG. 4, in using the bookmark of the present invention to identify a specific page and line, the bookmark is placed on either the right-hand or left-hand page depending upon which page was last read by the user. With the display facing upwardly, the bookmark is moved either upwardly or downwardly to a position where the line to be indicated falls within the length of slit 14. Next, the bookmark is pressed against the selected page with one hand while the finger of the other hand is used to slide indicator element 16 along the track or slit until it aligns with a selected line, such as line 26.

It is to be understood that when the book is opened, the bookmark may fall against the right-hand page as shown by the solid lines in FIG. 4, or against the left-hand page as shown by the phantom lines. However, when the display indicia 18, which is imprinted on the bookmark, can be viewed, that is face up, the user will at once know that the page against which the back surface of the bookmark rests is the last page which was being read. Then by looking at the line that is proximate the indicator element, the user will at once know the last line which was read.

It is to be understood that the display which is imprinted on the upper and lower terminal portions of the bookmark can be of any object such as an animal, a balloon, or group of balloons, a piece of fruit hanging of a tree, a bowl of fruit, an ornament, a pyramid, a flower, an egg, or any other display that includes at least one object-depicting feature having a particular size and shape and being located proximate the upper extremity of slit 14. When the bookmark is not in use, the object-depicting feature is covered by the line indicating element which is of the same size, shape, color and configuration as the object-depicting feature. When the bookmark is in use, the element which overlies the object-depicting feature can then be moved downwardly along slit 14 to function as the line indicator element. When the bookmark is not in use, element 16 can, once again, be moved upwardly of the track and be repositioned over the object-depicting feature of the display to which it corresponds. When in the position, the indicator element appears to be an integral part of the printed display itself. This novel feature, which is neither shown nor suggested by the prior art provides a highly commercially attractive aspect of the device of the invention and renders it both attractive and unique in appearance and operation.

Referring now to FIGS. 5 through 11 of the drawings, an alternate embodiment of the bookmark device of the present invention is there shown. This embodiment comprises an elongated body 112 having an upper terminal portion 112a and a lower terminal portion 112b. A longitudinally extending slit 114 extends between the upper and lower terminal portions and defines a track along which the indicator element 116 of the device can be moved in a manner presently to be described. As before, body 112 can be constructed from plastic, paper, cardboard, or any other suitably durable material.

Figure 7:
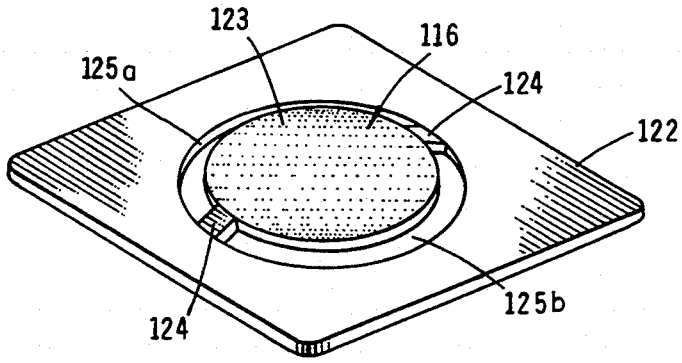
FIG. 7 is an enlarged generally perspective view of the indicator element of this alternate form of the invention.
Figure 8:
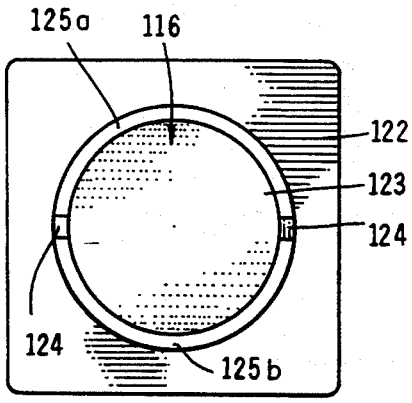
FIG. 8 is a top plan view of the indicator element.
Figure 9:
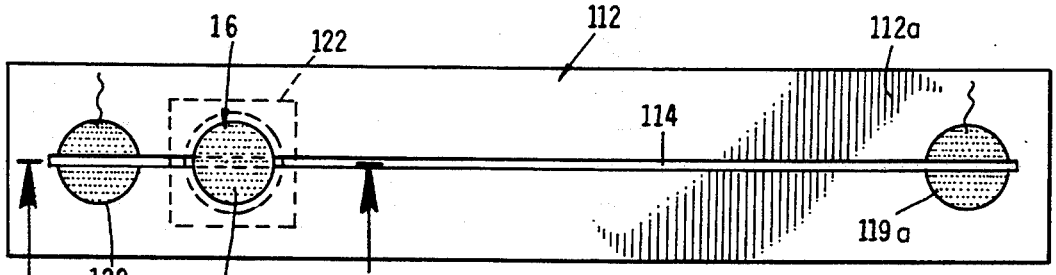
FIG. 9 is a plan view of the alternate form of the device.
Figure 10:
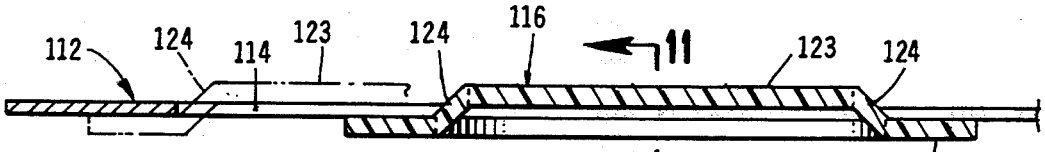
FIG. 10 is a cross-sectional view taken along lines 9—9 of FIG. 8.

In this latest form of the invention, indicator element 116 is of highly novel, one-piece construction and, as earlier described herein, functions to indicate a particular line on the selected page of a book such as the book shown in FIG. 4. Indicator element 116, which comprises the indicator means of the present embodiment of the invention is of a single piece construction and includes a backing or base portion 122 which, as best seen in FIG. 7, is interconnected with a face portion 123 by a pair of circumferentially spaced tabs 124. Base portion 122 can be rectangular, circular or of any other desired shape so long as it presents a larger area than face portion 123. Tabs 124 are of a length such that face portion 123 is at all times maintained in close proximity with the front face of body 112 and base portion 122 is at all times maintained in close proximity with the bottom face of body 112 as the indicator element slides along its guide track which is defined by slit 114. The connector means or tabs 124, are integral with both base portion 122 and face portion 123 and are formed by making two generally semicircular shaped cuts 125a and 125b in a single sheet of material such as a cuttable and deformable plastic material (see FIG. 7). As the cuts are made by die cutting or the like in a manner well known in the art, face portion 123 is pushed out of the plane of the sheet of material so as to cause a limited degree of stretching of the tabs 124 (see FIGS. 7 and 9). When the indicator element is formed in this manner, face portion 123 will reside in a plane which is spaced apart from, but generally parallel to the plane of base portion 122. Preferably portion 123 is spaced from portion 122 by a distance slightly greater than the thickness of body 112. Tabs 124 will maintain the face portion in this elevated position and will also uniquely guide travel of the indicator element along slit 114.

Figure 5:
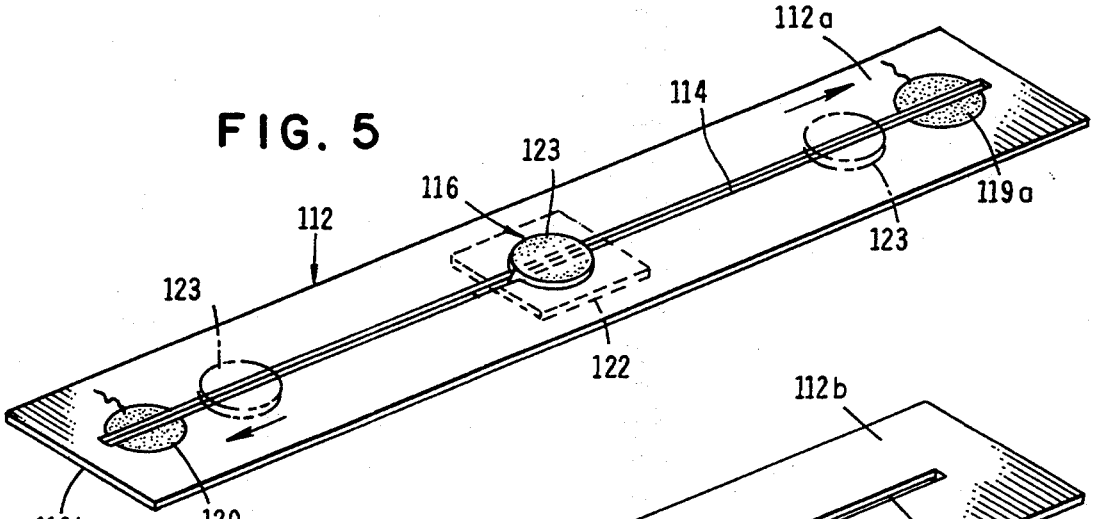
FIG. 5 is a generally perspective top view of an alternate form of bookmark device of the present invention.
Figure 6:
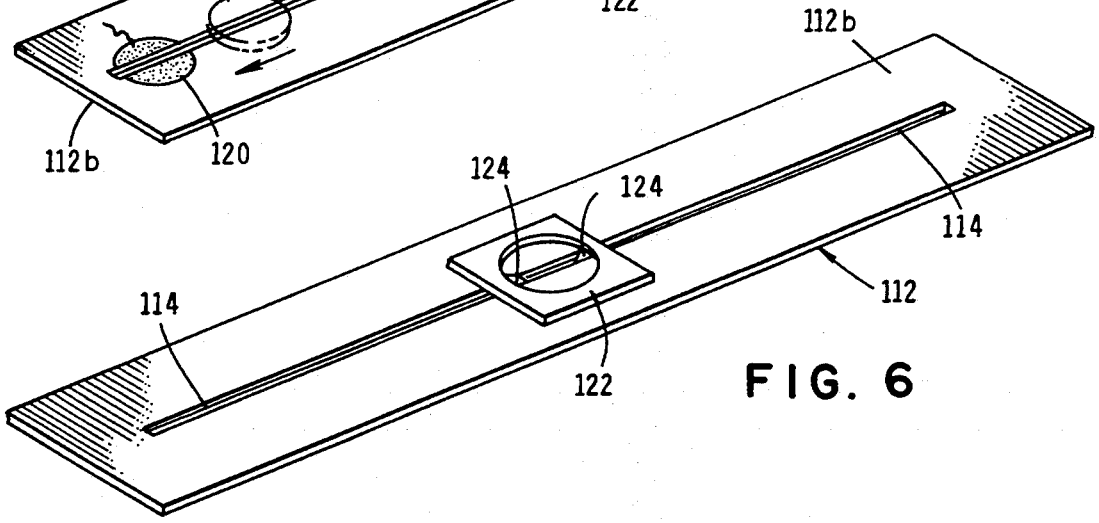
FIG. 6 is a generally perspective bottom view of the form of the bookmark device illustrated in FIG. 5.

As was the case with the earlier described embodiment, when the bookmark is not in use, face portion 123 of the indicator element overlies object-depicting feature 119a or 120 and appears to be a part of the imprinted display (FIG. 5). In use, however, the indicator element can be moved away from the display, either upwardly or downwardly in the manner illustrated in FIG. 5, and into alignment with a specific line of print. As before, designs can be imprinted on both the upper and lower portions of the face of the bookmark and the indicator element can be moved from an overlying position on the upper design to an overlying position in the lower portion. Use of the bookmark and its positioning within the book being read is as previously described herein.

The display which is imprinted on the upper and lower terminal portions of the bookmark can be of any object, but is shown in FIG. 5 as being a balloon having a particular size and shape. When the bookmark is not in use, the balloon depiction is covered by the generally circular shaped face portion 123 of the line indicating element. When the bookmark is in use, the indicator element can then be moved downwardly along slit 114 to function as the line indicator element.

Figure 11:
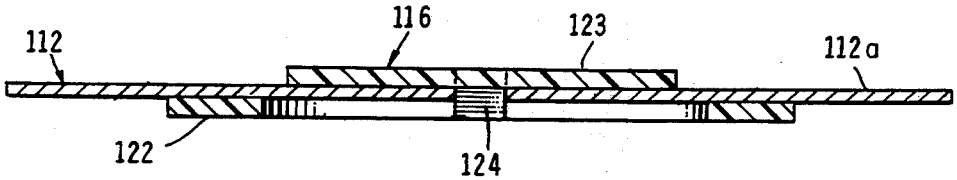
FIG. 11 is a cross-sectional view taken along lines 10—10 of FIG. 8.
Figure 12:
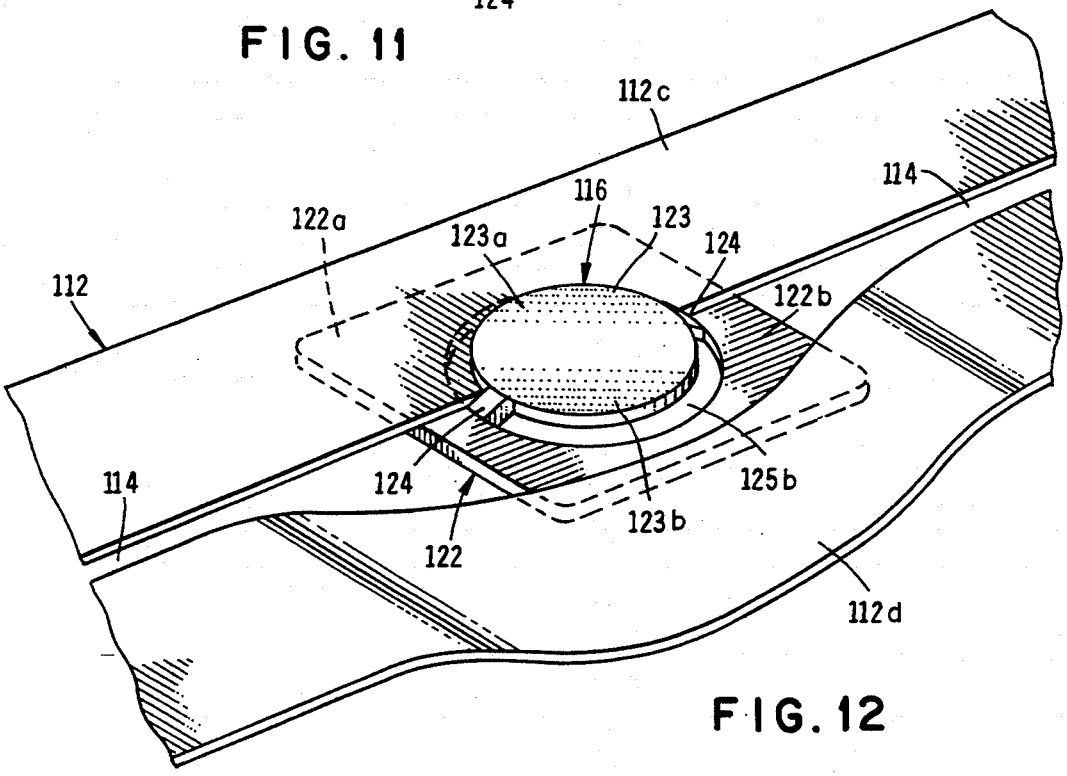
FIG. 12 is a fragmentary generally perspective view of the device illustrating the manner of assembly of the indicator element with the body portion of the alternate form of the device.

Turning now to FIG. 11, the indicator element is assembled with body 112 by slipping the side of the body 112 (designated in FIG. 11 as 112c) between the halves of the base portion 122 and the face portion 123 of the indicator element (designated as 122a and 123a). Next, side 112d of the body is yieldably deformed downwardly a sufficient distance to permit its insertion between the halves of the base portion 122 and the face portion 123 which are designated in FIG. 11 as 122b and 123b respectively. When the body is permitted to spring back into its normal planar configuration, tabs 124 will be closely disposed within slit 114 so that the indicator element can freely slide along the track formed by the slit. To enable the resilient deformation of body 112, both the body and the indicator means are preferably formed of a suitable cuttable and resiliently deformable sheet of plastic such as various acrylic plastics, polyvinyl, polypropylene and like plastic materials. However, the components can also be constructed from a variety of cardboard like composite materials in sheet form.

Referring now to FIGS. 13 through 18, still another embodiment of the bookmark device of the present invention is there shown. This embodiment is similar in many respects to the embodiment just described and like numerals are used to describe like components. The bookmark of this latest form of the invention also comprises an elongated body 112 having an upper terminal portion 112a and a lower terminal portion 112b. A longitudinally extending slit 114 extends between the upper and lower terminal portions and defines a track along which the indicator element 130 of the device can be moved in a manner presently to be described. As before, body 112 can be constructed from plastic, paper, cardboard, or any other suitably durable material.

Figure 18:
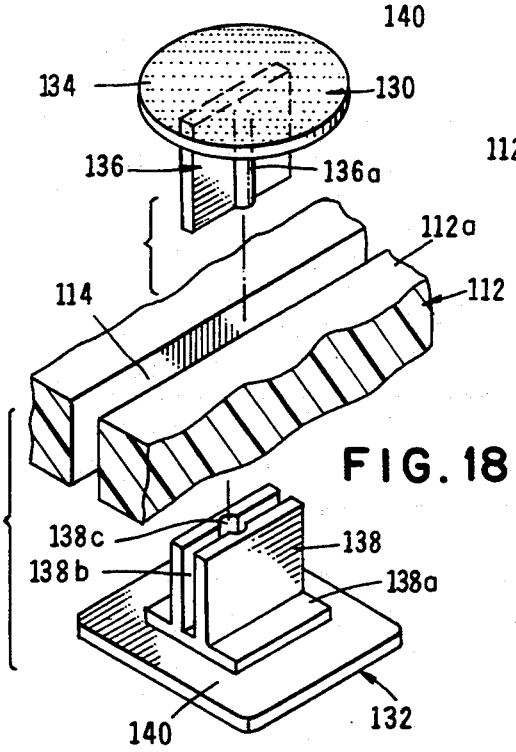
FIG. 18 is a fragmentary generally perspective, exploded view of the device illustrating the manner of assembly of the indicator element with the body portion of this latest form of the device.

In this latest form of the invention, indicator element 130 is of a unique, interlocking construction and, as earlier described herein, functions to indicate a particular line on the selected page of a book such as the book shown in FIG. 4. Indicator element 130, which comprises the indicator means of the present embodiment of the inventions includes a backing or base assembly 132 which, as best seen in FIG. 18, is interconnected with a face portion 134 by interconnection means here comprising downwardly depending element 136. Base assembly 132 comprises an upstanding, slotted connector member 138 which is affixed to a base member 140. Element 136 of a length such that when connected to assembly 132 face portion 134 is at all times maintained in close proximity with the front face of body 112 and flange 138a of connector 138 is at all times maintained in close proximity with the bottom face of body 112 as the indicator element slides along its guide track which is defined by slit 114 (see FIGS. 15 and 16).

Figure 15:
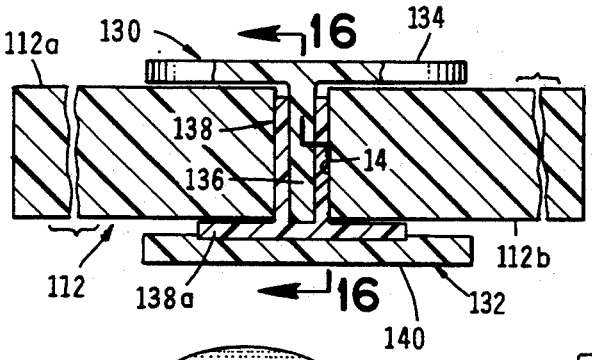
FIG. 15 is a cross-sectional view taken along lines 15—15 of FIG. 13.
Figure 17:
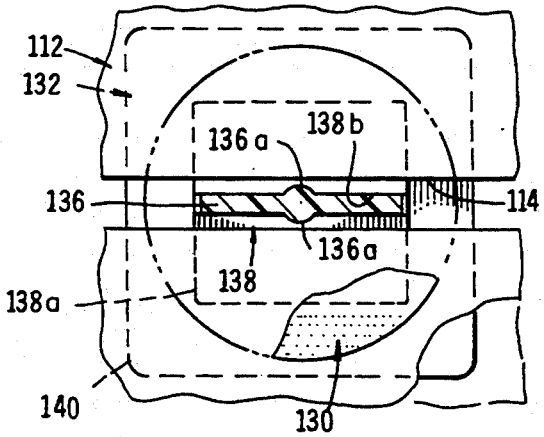
FIG. 17 is a cross-sectional view taken along lines 17—17 of FIG. 16.

The slot 138b of connector member 138 is of a width to frictionally receive element 136 so that when member 136 is mated with the base assembly in the manner shown in FIG. 15, the parts will remain together. Member 138 is also provided with a bore 138c which closely receives protuberances 136a formed on element 136 (FIG. 17). In this way, element 136 will be precisely centered with respect to base assembly 132 when the cooperating components are mated. Base assembly 132 as well as face portion 134 and element 136 can be constructed of various materials including various types of moldable plastic.

Figure 16:
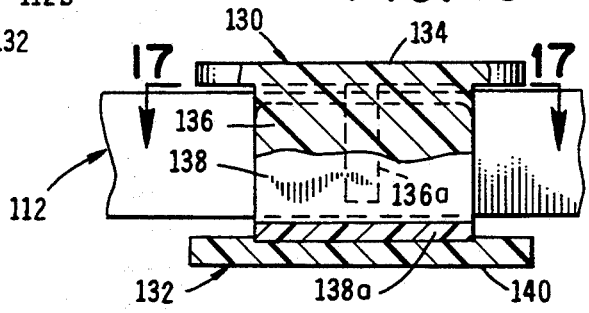
FIG. 16 is a cross-sectional view taken along lines 16—16 of FIG. 15.

When the indicator element is assembled in this manner, shown in FIGS. 15 and 16, face portion 134 will reside in a plane which is spaced apart from, but generally parallel to the plane of base portion 140 and element 136 will precisely guide the travel of the indicator element along slit 114.

Figure 13:
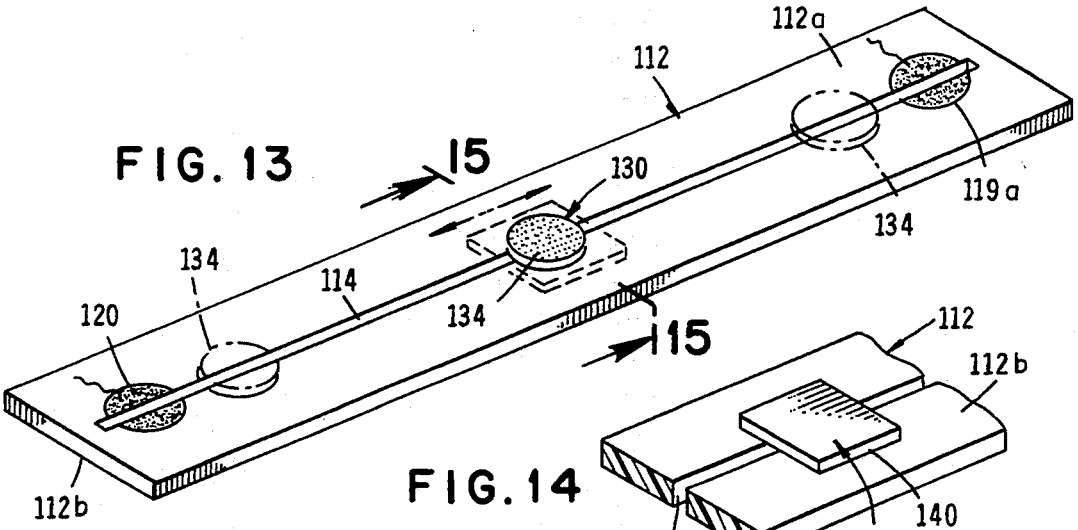
FIG. 13 is a generally perspective top view of still another form of bookmark device of the present invention.
Figure 14:
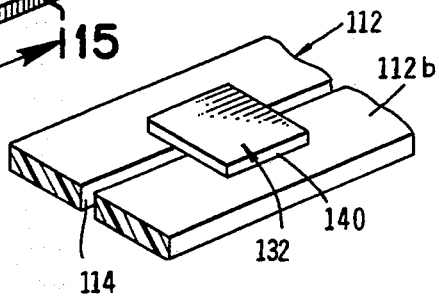
FIG. 14 is a generally perspective, fragmentary bottom view of the form of the bookmark device illustrated in FIG. 5.

As was the case with the earlier described embodiment, when the bookmark is not in use, face portion 123 of the indicator element overlies object-depicting feature 119a or 120 and appears to be a part of the imprinted display (FIG. 13). In use, however, the indicator element can be moved away from the display, either upwardly or downwardly in the manner illustrated in FIG. 13, and into alignment with a specific line of print. Use of the bookmark and its positioning within the book being read is as previously described herein.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A bookmark for locating an exact page and line in a book comprising:

(a) an elongated body having an upper terminal portion, a lower terminal portion and a slit having a width and extending between said upper and lower terminal portions, said slit defining a track;

(b) a display imprinted on one of said upper and lower terminal portions of said body, said display including at least one object depicting feature having a particular size and shape and being located proximate said slit; and (c) an indicator means for indicating a particular line on a selected page of the book, said indicator means comprising an indicator element having a face portion disposed in a first plane and being of a size and shape generally corresponding to the size and shape of said object-depicting feature of said display, said indicator element also including a base portion disposed in a second plane spaced apart from said first plane, said base portion having an aperture defining an inner edge, said face portion having an outer edge defining an area smaller than said aperture, said face portion being connected to said base portion by connector means including a pair of oppositely disposed connector elements passing through said slit and connecting the outer edge of said face portion to said inner edge of said base portion, whereby said indicator element is movable along said track from a first position overlying said object-depicting feature to a second position intermediate said upper and lower terminal portions of said body.

2. A bookmark as defined in claim 1 in which said object depicting feature is generally circular in shape and said indicator element is generally disc shaped.

3. A bookmark as defined in claim 2 in which said indicator element is formed of a material which comprises a deformable plastic.

4. A bookmark as defined in claim 2 in which said display comprises a depiction of an object, said depiction being substantially circular in shape.

5. A bookmark for locating an exact page and line in a book comprising:

(a) a thin, elongated, planar body having a face and a back, said face having an upper terminal portion and a lower terminal portion, said body having a slit extending between said upper and lower terminal portions, said slit defining a track;

(b) a first display imprinted on said upper terminal portion of said face of said body, said first display including at least one object depicting feature having a particular size and shape and being located proximate said slit;

(c) a second display imprinted on said lower terminal portion of said face of said body, said second display including an object-depicting feature generally corresponding to said object-depicting feature imprinted on said upper terminal portion; and (d) an indicator means for indicating a particular line on a selected page of the book, said indicator means comprising:

(i) a generally planar base portion disposed within a first plane;

(ii) a generally planar face portion disposed within a second plane, said second plane being spaced apart from said first plane; and (iii) connector means for interconnecting said generally planar face portion and said generally planar base portion through said slit, said connector means comprising a pair of oppositely disposed connector elements disposed between generally arcuately shaped openings formed in said indicator means.

6. A bookmark as defined in claim 5 in which said object depicting feature of said first and second display comprise a depiction of an object which is substantially circular in shape.

7. A bookmark as defined in claim 5 in which said indicator means is constructed from a thin sheet of cuttable and deformable plastic.

8. A bookmark for locating an exact page and line in a book comprising:

(a) a thin, elongated, planar body having, a face and a back, said face having an upper terminal portion and a lower terminal portion, said body having a slit extending between said upper and lower terminal portions, said slit defining a track;

(b) a display imprinted on said upper terminal portion of said face of said body, said display including at least one object depicting feature having a particular size and shape and being located proximate said slit; and (c) an indicator means for indicating a particular line on a selected page of the book, said indicator means comprising:

(i) a generally planar face portion overlying said face of said body proximate said slit and having a size and shape corresponding to the size and shape of said object-depicting feature of said display, said indicator means being movable along said track from a first position overlying said object-depicting feature to a second position on said face intermediate said upper and lower terminal portions of said body;

(ii) a generally planar base portion overlying said back of said body-proximate said slit; and (iii) connector means for interconnecting said generally planar face portion and said generally planar base portion through said slit, said connector means comprising connector elements defined by interrupted portions of a non-continuous slit formed in said indicator means.

9. A bookmark as defined in claim 10 in which said object-depicting feature is generally circular in shape and said indicator means is generally disc shaped.

10. A book mark for locating an exact page and line in a book comprising:

(a) an elongated body having an upper terminal portion, a lower terminal portion and a slit having a width and extending between said upper and lower terminal portions, said slit defining a track;

(b) a display imprinted on one of said upper and lower terminal portions of said body, said display including at least one object depicting feature having a particular size and shape and being located proximate said slit; and (c) an indicator means for indicating a particular line on a selected page of the book, said indicator means comprising an indicator element having a face portion disposed in a first plane and being of a size and shape generally corresponding to the size and shape of said object-depicting feature of said display, said indicator element also comprising a base assembly, including a base disposed in a second plane spaced apart from said first plane, said face portion being connected through said slit to said base assembly by a connector element having a width slightly less than said width of said slit whereby said indicator element is movable along said track from a first position overlaying said object-depicting feature of a second position intermediate said upper and lower terminal .portions of said body, said assembly further including a slotted member having a slot adapted to frictionally receive said connector element.

11. A bookmark as defined in claim 10 in which said connector element includes a pair of circumferentially spaced protuberances and in which said slotted member is provided with a bore for receiving said protuberances.

* * * * *